US006124548A

United States Patent [19]

Suzuki et al.

[11] Patent Number: 6,124,548

[45] **Date of Patent: *Sep. 26, 2000**

[54] WIRE ASSEMBLY APPARATUS AND METHOD FOR ASSEMBLING WIRES

[75] Inventors: Koutaro Suzuki; Jun Nakata, both of Yokkaichi, Japan

[73] Assignee: Sumitomo Wiring Systems, Ltd., Japan

[ * ] Notice: This patent is subject to a terminal disclaimer.

[21] Appl. No.: 09/268,579

[22] Filed: Mar. 15, 1999

Related U.S. Application Data

[63] Continuation of application No. 08/568,862, Dec. 5, 1995, Pat. No. 5,945,635.

[30] Foreign Application Priority Data

Jan. 11, 1995 [JP] Japan ..... 7-2855
Dec. 28, 1995 [JP] Japan ..... 6-328546

[51] Int. Cl.[7] ..... H01B 13/00; B21F 27/00

[52] U.S. Cl. ..... 174/72 A; 29/745; 29/755; 29/760; 140/93 R

[58] Field of Search ..... 174/72 A; 29/745, 29/755, 760; 140/93 R; 439/441, 542

[56] References Cited

U.S. PATENT DOCUMENTS 3,769,701 11/1973 Kloth ..... 174/72 A
3,930,524 1/1976 Tarbox ..... 140/93 R
4,978,315 12/1990 Edgley et al. ..... 439/441
5,945,635 8/1999 Suzuki et al. ..... 174/72 A

FOREIGN PATENT DOCUMENTS 52 701 of 1966 Germany ..... 174/72 A
23 44 950 of 1975 Germany .
58-192209 of 1983 Japan .
61-104505 of 1986 Japan .
4-304109 of 1992 Japan ..... 174/72 A

*Primary Examiner*—Hyung-Sub Sough
*Attorney, Agent, or Firm*—Anthony J. Casella; Gerald E. Hespos; Micheal J. Porco

[57] ABSTRACT

A retainer (A) aligns and retains ends (E) of branch wires (W1) and wires (W2) to be connected with the branch wires (W1) by means of a wire retaining portion (U). The wire retaining portion (U) is formed with cavities (42) which have a specified depth and into which the wires (W1,W2) are individually inserted, and contact members (60) for coming into contact with the wires (W1,W2) inserted into the cavities (42). The contact members (60) prevent the wires (W1,W2) from coming out of the cavities (42). The contact members (60) also move away from the wires (W1,W2) when necessary. The ends (E) of the branch wires (W1) and the wires (W2) to be connected with the branch wires (W1) can be aligned and retained during a wire arranging operation. After forming a bundle of wires, the wires (W1,W2) can be released from the retainer (A) with their ends (E) aligned. The aligned ends (E) can be easily processed at one time. The number of the wires (W1,W2) to be retained can be easily confirmed.

10 Claims, 13 Drawing Sheets

WIRE ASSEMBLY APPARATUS AND METHOD FOR ASSEMBLING WIRES

This is a continuation of Ser. No. 08/568,862, which was filed on Dec. 5, 1995, now U.S. Pat. No. 5,945,635.

BACKGROUND OF THE INVENTION

1. Field of the Invention

The present invention relates to a wire assembly apparatus, in particular for assembling wire harnesses and a method for assembling wires, in particular by using a wire assembly apparatus according to the invention.

2. Description of the Prior Art

A wiring harness is generally formed by arranging a multitude of long, processed wires on the wire arrangement board. Prior art long processed wires often include a spliced wire having a branch wire as shown in FIG. 17. The spliced wire is used to form a branch circuit for the wiring harness.

The above spliced wire is formed as follows. With reference to FIG. 17, an insulating sheath of a wire 1 as a main wire is peeled off in a specified position 1*a*, and an insulating sheath of a wire 2 as a branch wire is peeled off at an end 2*a*. Portions 1*a*, 2*a* of the wires 1, 2 where the sheath is peeled off are brought into contact with each other and connected by a connection terminal 3. This spliced wire needs to be formed before the wire arranging operation, and it is cumbersome to form it. Further, the spliced wires may get entangled during the wire arranging operation, thereby making this operation difficult. Therefore, there has been a demand for eliminating the spliced wires from the long processed wires for forming the wiring harness.

As a means to meet the above demand, a wiring harness producing method disclosed in Japanese Unexamined Patent Publication No. 58-192209 is known. According to this method, wires forming a wiring harness are divided into branch wires and straight wires to be connected with the branch wires, and terminal fittings are mounted at ends of the branch and straight wires. The branch wires and the straight wires are arranged on a wire arrangement board and connected with each other via connectors. In this way, there can be produced a wiring harness including the branch wires in conformity with the specification. However, this method requires a connector for each branch wire, leading to an increased production cost. In addition, the produced wiring harness has a large bulk of connectors. Accordingly, wiring is difficult if this wiring harness is used for an automotive vehicle to be installed in a narrow space such as the interior of a door.

As a means to solve the above problem, a wiring harness producing method disclosed in Japanese Unexamined Patent Publication No. 61-104505 is known. According to this method, branch wires and wires to be connected with the branch wires are pulled out of a bundle of main wires so as to gather portions to be connected in one place. The gathered portions to be connected are connected at one time by means of welding.

However, according to the latter wiring harness producing method, the branch wires and the wires to be connected with the branch wires are pulled out of the formed bundle of wires after all wires are arranged. Therefore, according to this method, the wire pulling operation to gather the portions to be connected needs to be performed separately from the wire arranging operation. In addition, the wire pulling operation is generally difficult and, therefore, takes a long time.

Thus, when a wiring harness is assembled on an assembly line according to this method, a maximum time, a so-called tact time, required for the wire pulling operation has to be longer than the times required for the other operations. This results in a poor production efficiency, thereby engendering a new problem: this method is not suitable for a line production.

Further, because of the difficulty to confirm the number of wires to be pulled out, some wires may not be pulled and a defective wiring harness may be manufactured.

The problem may be avoided if the wires to be pulled out later are separated from the other wires in advance during the wire arranging operation. However, this method requires devices for holding the separated wires during the wire arranging operation.

In view of the above, an object of the invention is to provide an improved wire assembly apparatus and an improved method for assembling wires, which allow a compact assembly of the wires at an advantageously improved production efficiency.

SUMMARY OF THE INVENTION

This object is solved according to the present invention by a wire assembly apparatus and by a method for assembling wires.

According to the invention there is provided a wire assembly apparatus, comprising a base to be mounted on a wire arrangement board on which wires are to be arranged, and retaining means at least temporarily connected with the base and adapted to retain portions of the arranged wires.

According to a preferred embodiment of the invention, the retaining means comprises a retaining portion adapted to retain the wires with an elastic force.

Preferably, the retaining means comprises a contact surface which is formed at a front portion of the retaining means and extends in a direction substantially normal to the longitudinal direction of the wires, and with which the ends of the wires come into contact to be aligned and positioned.

Further preferably, the retaining means comprises an elastic block.

According to a further preferred embodiment, the retaining portion comprises opposite inner wall surfaces of at least one through groove formed therein, the through groove extending over an entire dimension of the retaining portion along the longitudinal direction of the retained wires.

Preferably, the retaining means comprises a pair of opposite elastic blocks which are spaced apart by a specified distance, wherein the retaining portion comprises preferably the opposite wall surfaces of the opposite blocks.

Further preferably, the retaining portion is provided with a partition plate for aligning the wires to be retained, wherein the retaining means is preferably detachably mountable on the base.

According to still a further preferred embodiment, the retaining means comprises a plurality of cavities for accommodating portions of the arranged wires, wherein the retaining means comprises preferably at least one contact member having a first position where it is in contact with the wires accommodated in the retaining means, in particular in the cavities and a second position where it is away from the wires.

Further preferably, the contact member restricts a movement of the wires in a direction opposite to an insertion direction in its first position, while it permits a movement of the wires in its second position.

According to a further preferred embodiment, the retaining means comprises a contact surface with which the ends of the wires inserted into the retaining means, in particular the respective cavities come into contact to be aligned and positioned.

Preferably, the retaining means comprises a casing which is mounted on the base and has at least one opening, and a wire housing block which is withdrawably insertable into the casing such that one end surface thereof is exposed through one opening of the casing, wherein each cavity is preferably formed in the wire housing block and comprises a hole having an opening in the one end surface of the wire housing block and having a specified depth.

Further preferably, the contact member is mounted on the wire housing block and comprises at least one elastic claw which can undergo such an elastic deformation that it enters the hole when the wire housing block is inserted into the casing, while it moves away from the hole when the wire housing block is withdrawn from the casing, wherein the elastic claw is preferably disposed such that the leading end thereof are at an acute angle to the insertion direction of the wires into the cavities when the elastic claw is located in the cavities.

According to the invention there is further provided a method for assembling wires, in particular by using a wire assembly apparatus according to one of the preceding claims, comprising the following steps of:

arranging a plurality of wires on a wire arrangement board, retaining portions of at least a part of the plurality of wires by a retaining means, binding predetermined or predeterminable portions of the wires with binding means, and releasing the retained wires from the retaining means.

According to a preferred embodiment of the invention, the method further comprises the step of end-processing end portions of the retained wires, in particular by resistance welding, ultrasonic welding, soldering or mounting of terminals or connectors, wherein the step of end-processing is performed after the step of binding and before the step of releasing or after the step of releasing, wherein the end-processing is preferably applied to all the retained wires at one time.

Preferably, the retaining step comprises the step of inserting the part of the plurality of wires into cavities of the retaining means.

Further preferably, the retaining step comprises the step of bringing the part of the plurality of wires into contact with a contact member of the retaining means, in particular by deforming elastic claw of the contact member for securing the part of the plurality of wires, wherein the step of deforming the elastic claw preferably comprises the step of inserting a housing block of the retaining means into a casing of the retaining means.

Further preferably, the retaining step comprises the step of inserting the part of the plurality of wires inside a clearance of an elastic block of the retaining means.

Further preferably, the retaining step comprises the step of aligning the part of the plurality of wires, in particular by bringing them into contact with a contact surface of the retaining means.

Still further preferably the method for assembling wires further comprises the step of counting the retained wires or verifying the number of retained wires.

According to a further preferred embodiment of the invention there is provided a wire assembly apparatus, which comprises a base to be mounted on a wire arrangement board for arranging wires, and retaining means which is coupled with the base and adapted to retain ends of the arranged wires, wherein the retaining means comprises a plurality of cavities for accommodating the ends of the arranged wires which are to be inserted through their specified openings along the longitudinal direction; a contact member having a first position where it is in contact with the wires accommodated in the cavities and a second position where it is away from the wires, the contact member restricting a movement of the wires in a direction opposite to the insertion direction in its first position, while permitting the movement of the wires in its second position; and a contact surface with which the ends of the wires inserted into the respective cavities come into contact to be aligned and positioned.

This embodiment is in particular capable of aligning and retaining ends of branch wires and ends of wires to be connected with the branch wires during a wire arranging operation on an assembly line, simultaneously releasing all wires with their ends aligned, and conforming the number of the branch wires and the wires to be connected with the branch wires.

With this construction, the wire end retainer can be mounted on the wire arrangement board via the base. During the wire arranging operation, out of the wires being arranged, the ends of the wires constituting branch wires of a wiring harness after completion of assembling and the ends of the wires to be connected therewith are inserted into the cavities along the longitudinal direction. At this stage, only one wire is inserted into one individual cavity. Then, the contact member is brought into its first position and comes into contact with the wires inserted into the cavities, thereby restricting the movement of the wires in the direction opposite to the insertion direction. As a result, the wire ends can be retained while preventing the wires from coming out of the cavities. The ends of the wires inserted into the respective cavities come into contact with the contact surface. Accordingly, the respective wires are retained with their ends aligned. On the other hand, when the contact member is brought into its second position, the wires are allowed to be withdrawn from the cavities. Therefore, the retained wires can be released with their ends aligned.

Accordingly, while the ends of the wires to be retained are inserted into the cavities formed in the retaining means during the wire arranging operation, the contact members come into contact with the inserted wires to prevent them from coming out of the cavities. Further, the ends of the inserted wires come into the contact surface, thereby being aligned. Accordingly, the wires can be retained with their ends aligned during the wire arranging operation. Further, since only one wire is inserted into each individual cavity, the number of the retained wires can be easily grasped. As a result, the wire arranging operation can be performed while confirming the number of the branch wires and the wires to be connected therewith which are to be processed at one time. In addition, when the contact members move away from the wires, the retained wires can be released together with their ends aligned. Therefore, the ends of the retained wires can be easily processed at one time.

According to a further preferred embodiment, the retaining means is detachable from the base.

This construction has the same action as the precedent embodiment. In addition, the wires can be transferred with their ends aligned because the retaining means can be detached from the base.

Accordingly, an additional advantage is that the wires can be transferred while being retained with their ends aligned by detaching the retaining means from the base. As a result, the wires can be conveyed, with their ends aligned, to a specified apparatus for processing the ends of the wires at one time. Therefore, it is not necessary to realign the ends of the wires before they are processed at one time.

According to still a further embodiment, the retaining means comprises a casing which is mounted on the base and has an opening, and a wire housing block which is withdrawably inserted into the casing such that one end surface thereof is exposed through the opening of the casing; each cavity is formed in the wire housing block and comprises a hole having an opening in the one end surface of the wire housing block and having a specified depth; and the contact member is mounted on the wire housing block and comprise elastic claws which undergo such an elastic deformation that they enter the holes when the wire housing block is inserted into the casing, while undergoing such an elastic deformation that they move away from the holes when the wire housing block is withdrawn from the casing.

This construction has the same action as the precedent embodiment. Particularly, the elastic claws undergo such an elastic deformation that they enter the holes forming the cavities when the wire housing block is housed in the casing. If the wires are inserted into the holes through the opening of the casing in this state, the elastic claws are pressed and deformed by the wires. As a result, the wires are held between the inner walls of the holes and the elastic claws, thereby restricting the movement of the wires in the direction opposite to the insertion direction. Further, since the respective holes have a specified depth, the ends of the inserted wires can be aligned only by being brought into contact with the bottom surfaces of the holes. Upon detachment of the wire housing block from the casing, the elastic claws are deformed and move away from the holes, thereby moving away from the wires accommodated in the holes. As a result, the wires can be released together.

Particularly, according to this embodiment, upon insertion of the wire housing block into the casing, the elastic claws undergo such an elastic deformation that they contact the wires inserted into the cavities to prevent them from coming out of the cavities. Upon detachment of the wire housing block from the casing, the elastic claws undergo such an elastic deformation that they permit the wires from coming out of the cavities. Therefore, the wires can be retained with a very simple construction, and the retaining means can be manufactured at a reduced cost.

According to a further preferred embodiment, the elastic claws are disposed such that the leading ends thereof are at an acute angle to the insertion direction of the wires into the cavities when the elastic claws are located in the cavities.

This construction has the same action as the precedent embodiment. In addition, since the leading ends of the elastic claws are at an acute angle to the insertion direction of the wires, if the wires are pulled in the direction opposite to the insertion direction after insertion thereof into the cavities, the leading ends cut in the sheaths of the wires. Therefore, the wires inserted into the cavities cannot move in the direction opposite to the insertion direction.

Accordingly, upon insertion of the wires into the corresponding cavities, the leading ends of the elastic claws come into contact with the wires at an acute angle with respect to the insertion direction of the wires, thereby restricting the movement of the wires in the direction opposite to the insertion direction. Accordingly, the holding of the wires and the positioning of their ends can be simultaneously realized only be inserting the wires to the back of the cavities. As a result, the wires can be smoothly retained with their ends aligned.

According to a further preferred embodiment, the wire assembling apparatus comprises a base to be mounted on a wire arrangement board on which wires are to be arranged, and retaining means connected with the base and adapted to retain ends of the arranged wires, wherein the retaining means comprises: a retaining portion having a specified length along the longitudinal direction of the wires to be retained and adapted to retain the wires with an elastic force; and a contact surface which is formed at a front portion of the retaining portion and extends in a direction substantially normal to the longitudinal direction of the wires to be retained, and with which the ends of the wires come into contact to be aligned and positioned.

Accordingly, the wire assembly apparatus is in particular capable of aligning and retaining ends of branch wires and ends of wires to be connected with the branch wires during a wire arranging operation on an assembly line, and simultaneously releasing all wires with their ends aligned.

The wire end retainer thus constructed can be mounted on the wire arrangement board used to perform the wire arranging operation via the base. The ends of the wires which act as branch wires of a wiring harness after the completion of assembling and the ends of the wires to be connected with the branch wires can be retained with an elastic force by the retaining portion during the wire arranging operation. While the wires are retained, their ends are brought into contact with the contact surface, with the result that the ends of the respective wires to be retained can be positioned and aligned. Further, since the retaining portion extends along the longitudinal direction of the wires to be retained, the ends of the wires inserted into the retaining portion can be retained over the specified length along the longitudinal direction. On the other hand, by withdrawing the retained wires from the retaining portion, the wires can be released at one time with their ends aligned.

Accordingly, the ends of the wires which are branch wires of a wiring harness after assembling and the ends of the wires to be connected with the branch wires are retained by the retaining portion over a specified length along the longitudinal direction of the wires. Further, the ends of these wires are retained while being brought into contact with the contact surface. Accordingly, the ends of the respective wires can be retained while being aligned. Further, since the wire end retainer can be mounted on the wire arrangement board via the base, the ends of the wires can be aligned and retained during the wire arranging operation. On the other hand, by detaching the retained wires from the retaining portion, the wires can be detached at one time with their ends aligned.

According to a further preferred embodiment, the retaining means comprises an elastic block, and that the retaining portion comprises opposite inner wall surfaces of a through groove formed in the block, the through groove having an opening in the upper surface of the block and extending over an entire dimension of the block along the longitudinal direction of the retained wires.

This construction has the same action as the preceding embodiment. Particularly, the ends of the wires to be retained are pressed into the through groove from above the block through the opening along the radial direction thereof. Thus, the ends of the wires are retained with an elastic force by the opposite inner wall surfaces of the through groove.

An additional advantage of this embodiment is that the wires can be easily retained by the opposite inner wall surfaces of the through groove by pressing the ends of the wires to be retained into the through groove formed in the elastic block from above along their radial direction.

Accordingly, the ends of the wires can be smoothly aligned and retained during the wire arranging operation.

Preferably, the retaining means comprises a pair of opposite elastic blocks which are spaced apart by a specified distance and that the retaining portion comprises the opposite wall surfaces of the opposite blocks.

Accordingly, the ends of the wires to be retained are pressed into a clearance between the pair of blocks from above along the radial direction thereof. Thus, the ends of the wires are retained with an elastic force by the opposite wall surfaces of the blocks.

An additional advantage of this embodiment is that the ends of the wires to be retained can be easily retained between a pair of elastic blocks by pressing them between the elastic blocks from above along their radial direction. Accordingly, the ends of the wires can be smoothly aligned and retained during the wire arranging operation. Further, since the wires are retained between the wall surfaces of the pair of the blocks, no special processing for forming wire retaining surfaces is necessary. This leads to a reduced cost for parts.

According to still a further preferred embodiment, the retaining portion is provided with a partition plate for aligning the wires to be retained.

This construction has the same action as the preceding embodiments. In addition, the wires to be retained can be retained at the opposite sides of the partition plate. Thus, the wires can be aligned by the partition plate.

Accordingly, the retained wires can be aligned with the partition plate therebetween. This results in an advantage that the ends of the wires can be smoothly processed at one time after the wire arranging operation.

According to a further preferred embodiment, the retaining means is detachably mountable on the base.

This construction has the same action as the preceding embodiments. In addition, since the retaining means can be detached from the base, the wires can be transferred while being retained with their ends aligned.

Since the retaining means can be detached from the base, the wires can be transferred while being retained with their ends aligned. As a result, the ends of the wires can be processed at one time without checking the state of the end portions and realigning the ends E. Thus, the processing can be more smoothly performed.

These and other objects, features and advantages of the present invention will become more apparent upon a reading of the following detailed description and accompanying drawings.

DETAILED DESCRIPTION OF THE PREFERRED EMBODIMENT

Hereafter, one embodiment of the invention is described in detail by way of preferred embodiments with reference to the accompanying drawings.

Figure 1:
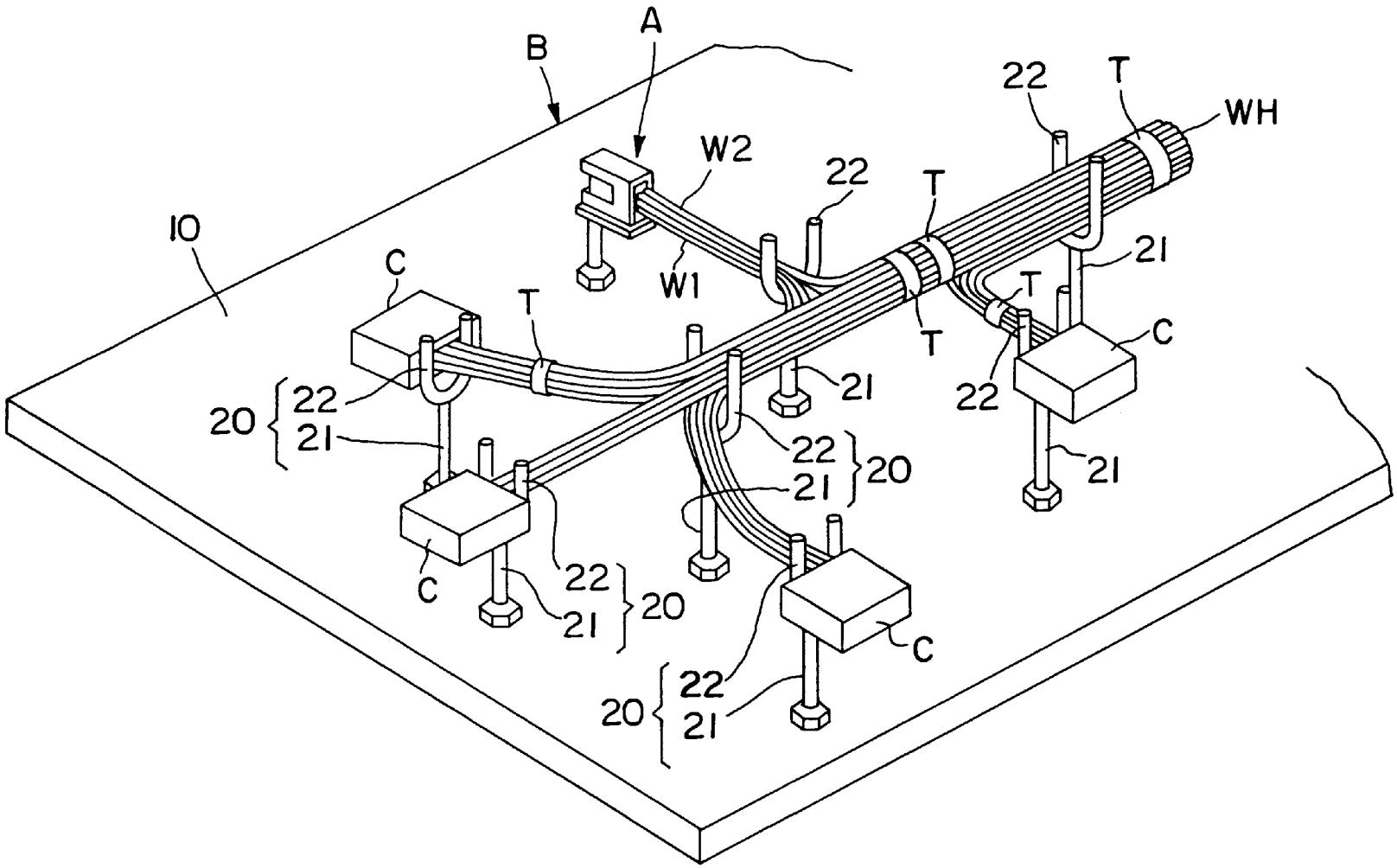
FIG. 1 is a perspective view showing an essential wiring harness manufacturing process using an assembling board equipped with a retainer or retaining means according to one embodiment of the invention.

FIG. 1 is a perspective view of a wiring harness WH being manufactured using an assembling board B equipped with a wire end retainer (hereafter, "retainer") A according to the embodiment of the invention.

With reference to FIG. 1, the assembling board B is conveyed along a wiring harness assembly line by a specified conveying apparatus (not shown). Along this assembly line, there are performed a wire arranging process of arranging a plurality of wires, an end retaining process of retaining ends of wires W1 as branch wires and wires W2 to be connected with the branch wires W1, a binding process of binding the arranged wires, and a releasing process of releasing a bundle of wires from the assembling board B. By subsequently performing an end-processing process of simultaneously processing the ends of the wires W1 and W2, the assembling of the wiring harness WH is completed. Identified by C are connectors mounted at the ends of the wires, and identified by T are binding tapes for suitably binding the wires during the wire arranging process and the binding process.

The assembling board B includes a wire arrangement board 10, a plurality of support members 20, and a retainer A. The board 10 is made of, for example, a veneer. The board 10 is a base plate for arranging a plurality of wires forming the wiring harness. A predesigned shape of the wiring harness can be drawn on the upper surface of the board 10.

The support members 20 stand upright on the board 10. Each support member 20 includes a support 21 secured on the board 10 and a wire receptacle 22 provided at the upper end of the support 21. The wire receptacle 22 is substantially U-shaped. The respective wires are arranged as predesigned while being held by the wire receptacles 22.

The retainer A is adapted to retain the ends of all branch wires W1 and the ends of the wires W2 to be connected with the branch wires W1. According to this embodiment, the ends of the wires W1 and W2 can be easily processed at one time by retaining the wires W1 and W2 by means of the retainer A with their ends aligned on the assembly line and by releasing the held wires W1 and W2 at one time.

Figure 2:
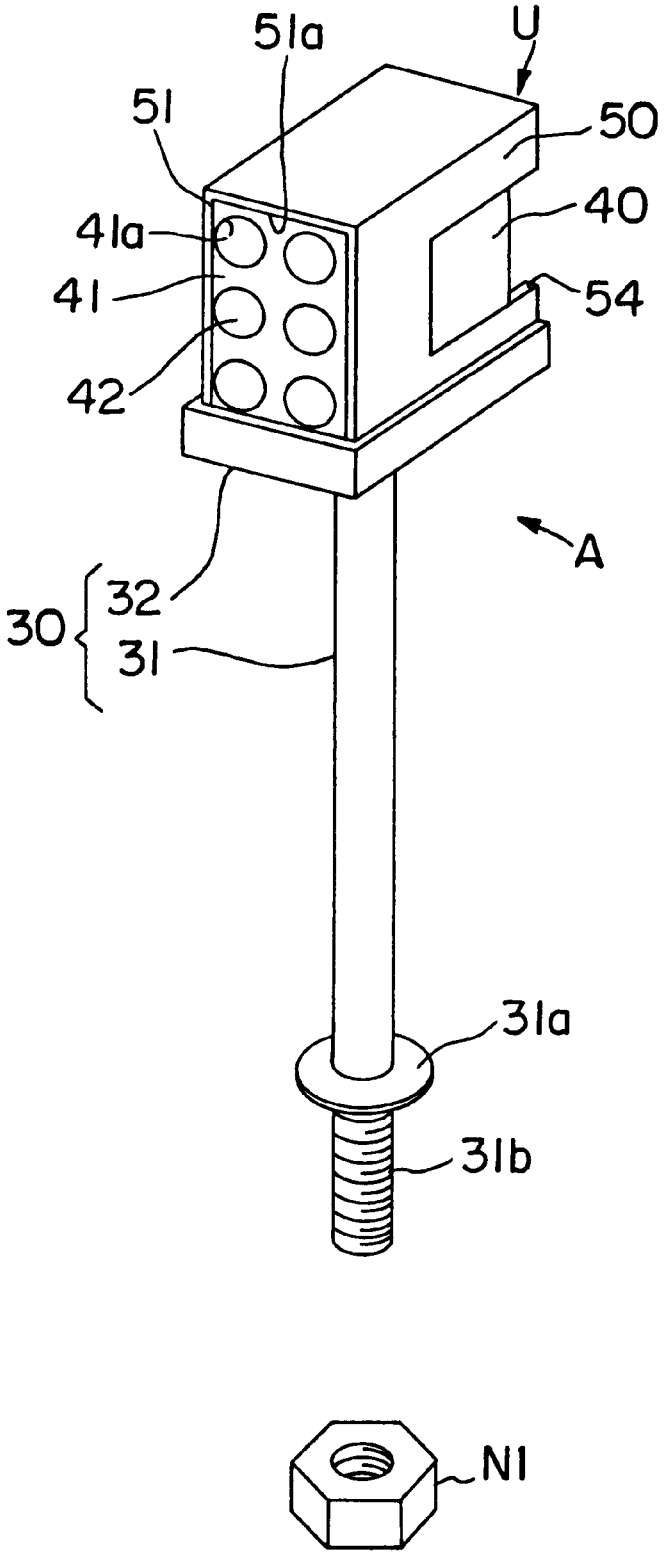
FIG. 2 is a front perspective view of the retainer.
Figure 3:
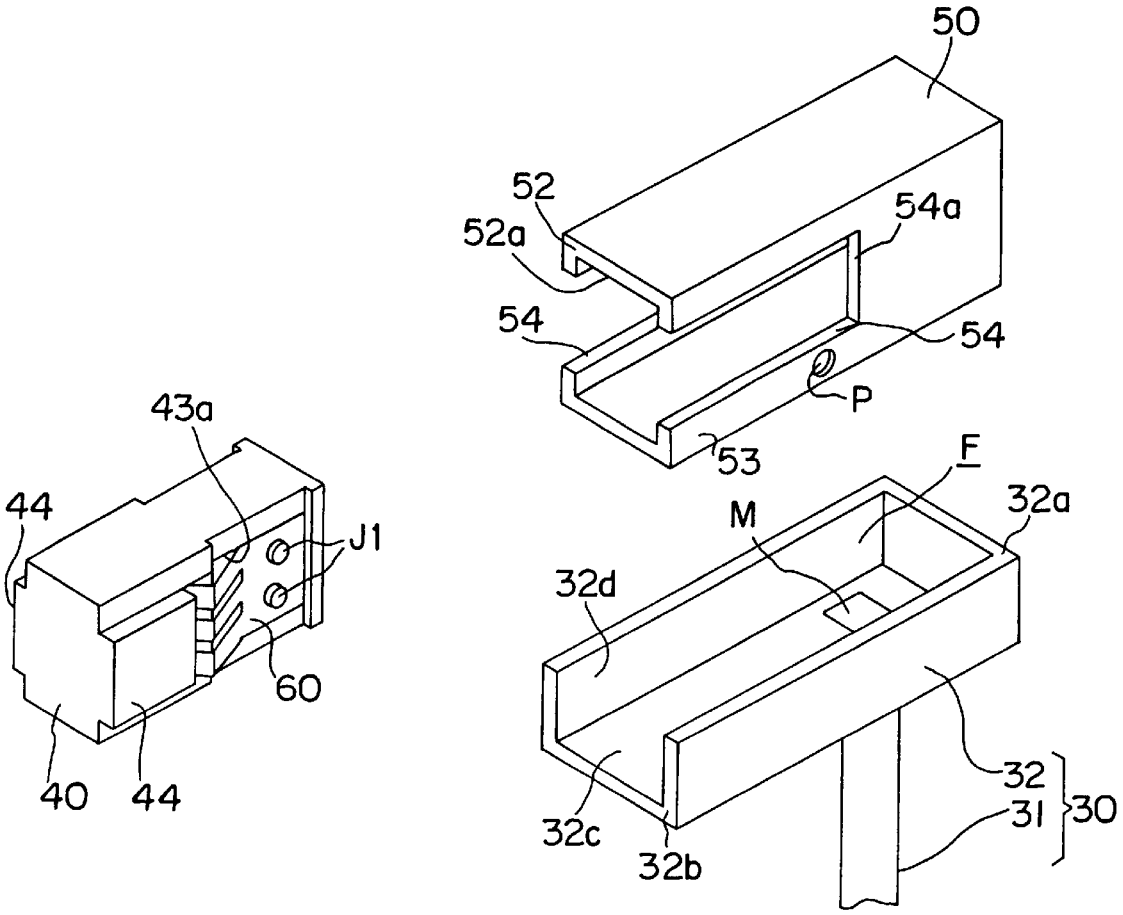
FIG. 3 is an exploded rear perspective view of the retainer.

FIG. 2 is a front perspective view of the retainer A, and FIG. 3 is a rear exploded perspective view of the retainer A. With reference to FIGS. 2 and 3, the retainer A is described in detail.

The retainer A includes a base 30 and a wire retaining portion U provided at the upper end of the base 30.

The base 30 includes a support 31 and a securing portion 32 in which the wire retaining portion U is placed.

The support 31 is bar-shaped and secured on the wire arrangement board 10. Specifically, a fixing flange 31*a* is formed at a lower portion of the support 31, and an external thread 31*b* is formed on the support 31 below the flange 31*a*. The lower portion of the support 31 is inserted through a mount hole formed in the board 10, and a nut N1 is screwed on the external thread 31*b* from the lower side of the board 10. In this way, the support 31 is secured on the board 10.

The securing portion 32 is box-shaped having an open upper wall portion 32*a* and an open rear wall portion 32*b*. A space F for placing the wire retaining portion U is defined by a bottom wall portion 32*c* and a side wall portion 32*d*. The bottom wall portion 32*c* of the securing portion 32 is coupled with the upper end of the support 31. The securing portion 32 may be formed separately from the support 31 and may then be coupled therewith. These two members may be integrally formed. A magnet M is disposed in a specified position of the bottom wall portion 32*c* such that it is exposed to the space F.

The wire retaining portion U includes a wire housing block 40 for housing and holding the wires W1 and W2, a casing 50 into which the wire housing block 40 is withdrawably inserted to be housed therein, and contact members 60 for coming into contact with the wires W1 and W2 accommodated in the wire housing block 40 and preventing the wires W1 and W2 from coming out of the wire housing block 40. The contact members 60 are mounted on the wire housing block 40.

Figure 4:
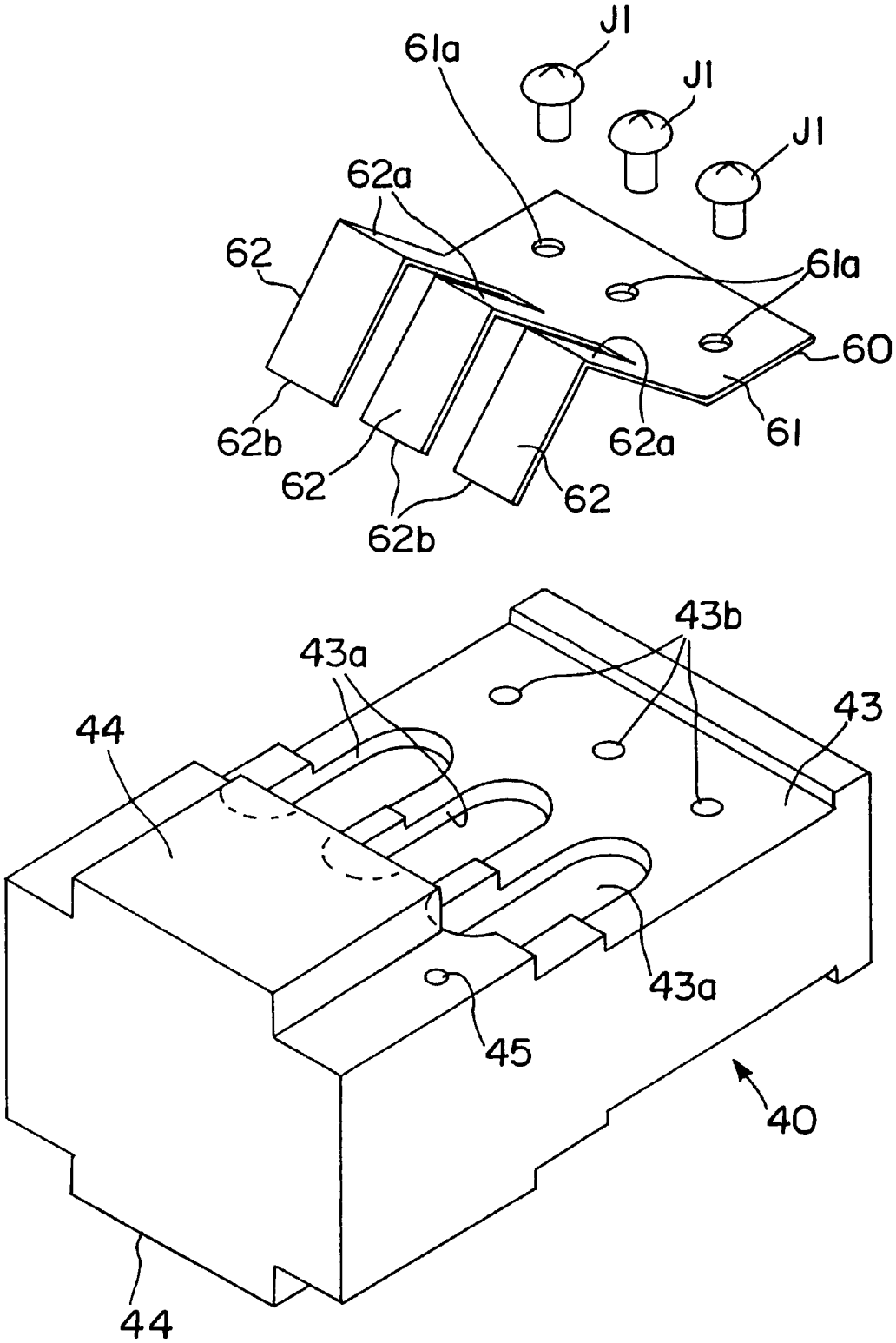
FIG. 4 is an exploded perspective view showing how a contact member is mounted on a wire housing block.

FIG. 4 is an exploded perspective view showing how the contact member 60 is mounted on the wire housing block 40.

Figure 5:
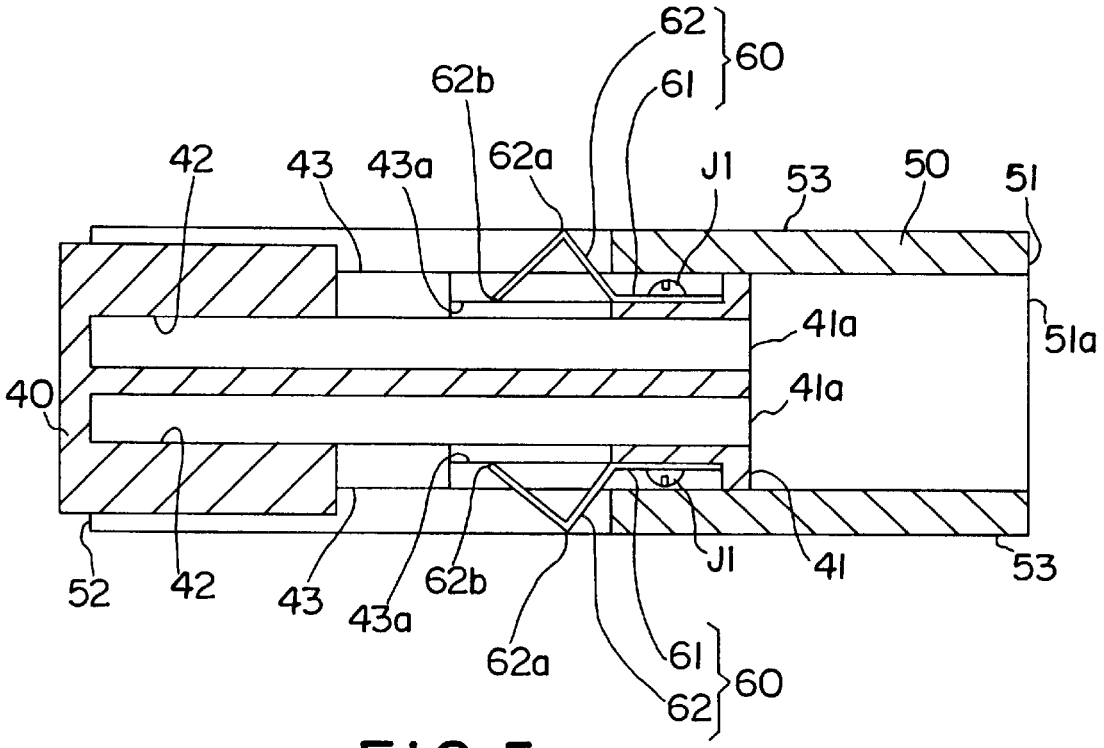
FIG. 5 is a horizontal section of a wire retaining portion before the wire housing block is set in the casing.

With reference to FIGS. 2 and 5, the wire housing block 40 is formed with a plurality of cavities 42 having openings 41*a* at one end surface 41 of the wire housing block 40. In this embodiment, two each of the cavities 42 are arranged at three vertical stages, i.e. six cavities 42 are formed. Each cavity 42 is a circular hole having a specified depth (see FIG. 5).

Three holes 43*a* in communication with the corresponding cavities 42 are formed in each of the opposite side walls 43 of the wire housing block 40 as shown in FIGS. 3–5. Mount holes 43*b* used to mount the contact members 60 are formed in the opposite side walls 43. A contact portion 44 is formed in a specified position preferably of each side wall 43 so that the wire housing block 40 can be properly positioned when it is accommodated in the casing 50. An engaging hole 45 engageable with a plunger P to be described later is formed in each side wall 43.

Each contact member 60 is made of a thin metal plate, and includes a base plate 61 and elastic claws 62 extending from the base plate 61. In this embodiment, there are formed three elastic claws 62. Mount holes 61*a* are formed in suitable positions of the base plate 61. The contact member 60 is mounted on the corresponding side wall 43 by inserting screws J1 into the holes 61*a* and screwing them into the mount holes 43*b* of the wire housing block 40.

Each elastic claw 62 is bent such that its middle portion points upward. Thus, when the contact members 60 are mounted on the wire housing block 40, peaks 62*a* of the elastic claws 62 project outward from the corresponding side walls 43 of the wire housing block 40, and leading ends 62*b* of the elastic claws 62 slightly enter the communication holes 43*a* and face the cavities 43. The elastic claws 62 can undergo an elastic deformation. More specifically, the elastic claws 62 have two positions: a first position where the leading ends 62*a* thereof are located in the cavities 42 (see FIG. 6) and a second position where they face the cavities 42. When the elastic claws 62 are in their first position, leading portions (between the peaks 62*a* and the leading ends 62*b*) of the elastic claw 62 are at an acute angle to an insertion direction of the wires W1 (W2).

With reference to FIGS. 2 and 3, the casing 50 is box-shaped, and openings 51*a*, 52*a* are formed in its front and rear walls 51, 52, respectively. A notch 54 extending from the opening edge of the opening 52*a* of the rear wall 52 toward the front wall is formed preferably in each side wall 53 of the casing 50. In accommodating the wire housing block 40 into the casing 50, the contact portions 44 of the wire housing block 40 are fitted in the notches 54 and guided therealong. Then, the contact portions 44 come into contact with edges 54*a* of the notches 54, thereby positioning the wire housing block 40 with respect to the casing 50.

At this stage, the end surface 41 of the wire housing block 40 is exposed at the opening 51*a* of the casing 50. A screw hole is formed in a specified position of each side wall 53 of the casing 50. The plunger P is screwed into this screw hole. The plunger P engages the engaging hole 45 formed in the wire housing block 40, thereby preventing the wire housing block 40 from coming out of the casing 50.

The casing 50 can be entirely made of metal. When the casing 50 is placed in the space F, it is attracted to the securing portion 32 due to an attraction of the magnet M so as to securely stay in the securing portion 32. The casing 50 may be formed of resin. In this case, a metal plate to be attracted to the magnet M may be mounted on the casing 50. The wire housing block 40 is disengaged from the casing 50 by withdrawing the wire housing block 40 in a direction opposite to the insertion direction while griping the contact portions 44 thereof with a hand or tool. This causes the plungers P and the engaging holes 45 to disengage, allowing the wire housing block 40 to be disengaged from the casing 50.

Figure 6:
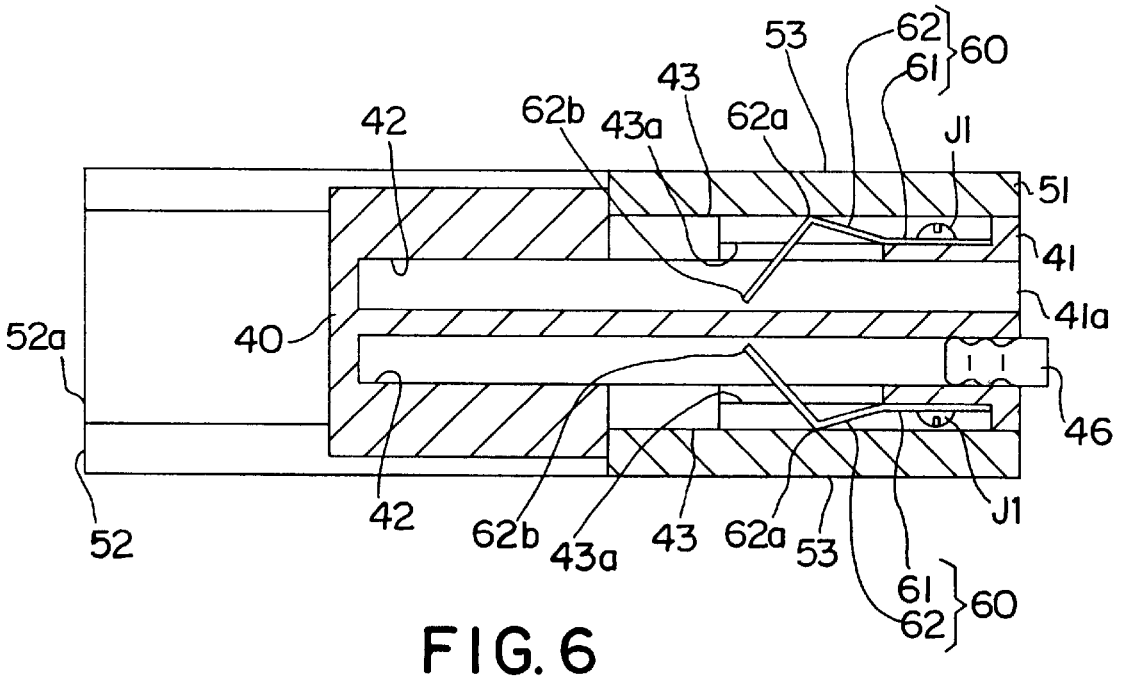
FIG. 6 is a horizontal section of the wire retaining portion after the wire housing block is set in the casing.
Figure 7:
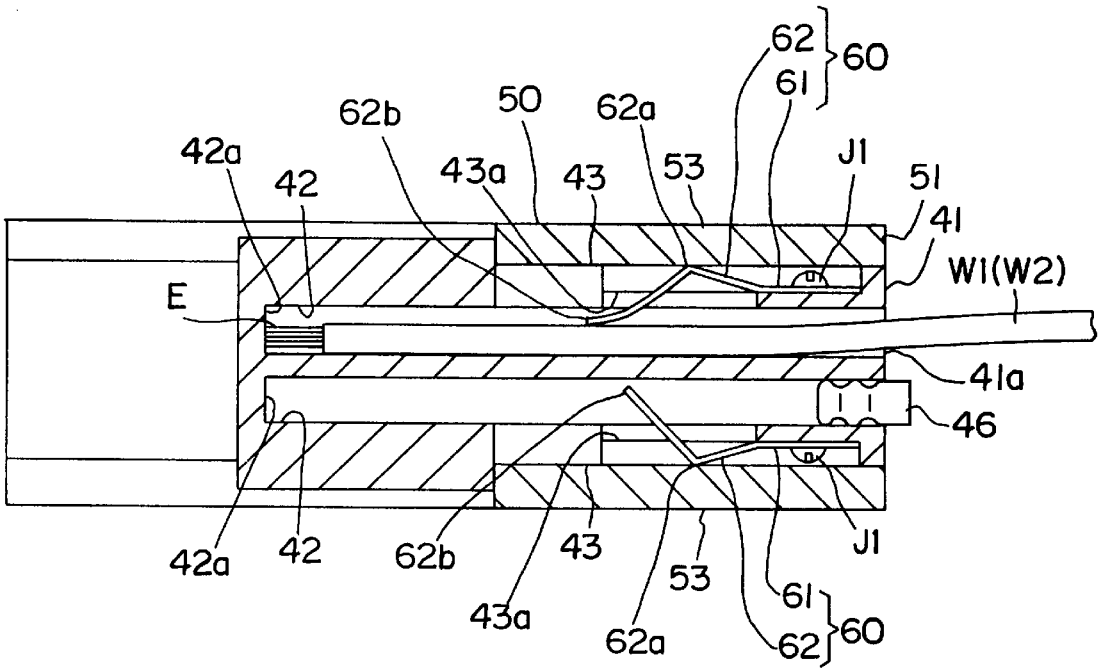
FIG. 7 is a horizontal section of the wire retaining portion when the wire is retained in the wire retaining portion.
Figure 8:
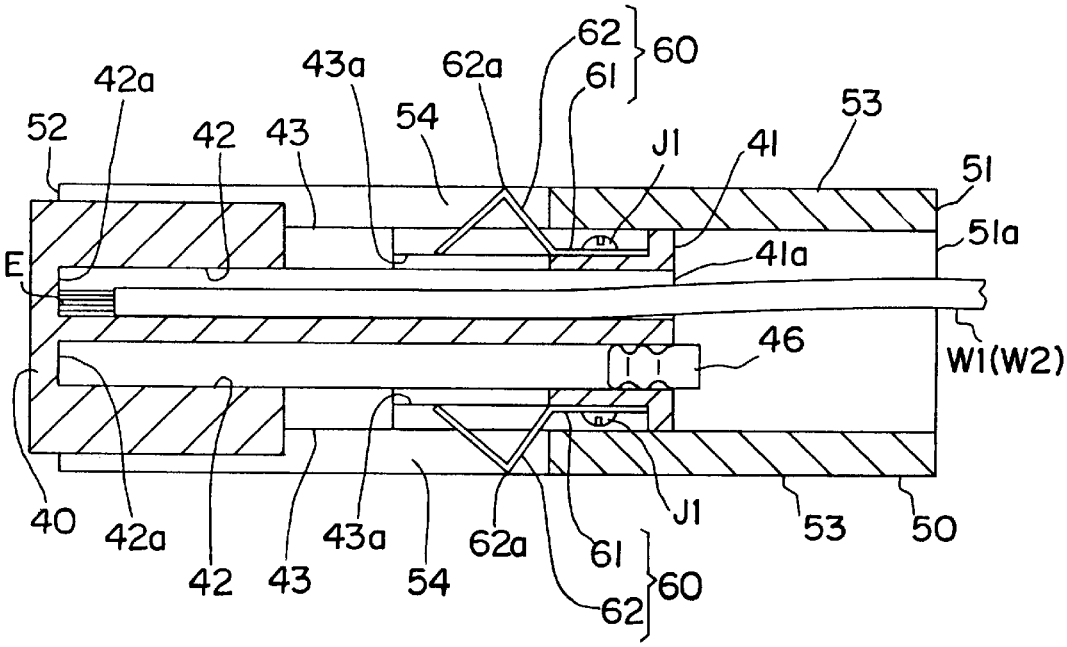
FIG. 8 is a horizontal section of the wire retaining portion while the retained wire is withdrawn from the wire housing block.

Next, a manufacturing method of the wiring harness with the use of the assembling board B and an operation of retaining the wires W1 and W2 using the retainer A are described with reference to FIGS. 5 to 8. FIGS. 5 and 6 are horizontal sections of the wire retaining portion U showing positional relationships of the wire housing block 40 and the casing 50. FIGS. 7 and 8 are horizontal sections of the wire retaining portion U when the wires W1 and W2 are accommodated in the wire housing block 40.

At the beginning of manufacturing of the wiring harness, the wires used to form the wiring harness are cut in desired lengths and terminals are mounted at ends of the desired wires by specified apparatuses and, as shown in FIGS. 5 and 6, the wire housing block 40 is set in the casing 50. Specifically, the wire housing block 40 is inserted into the casing 50 from the rear wall 52 with the end surface 41 thereof leading (see FIG. 5). By pressing the wire housing block 40, the elastic claws 62 come into contact with and are pressed against the side walls 53 of the casing 50. As a result, the elastic claws 62 are brought into their first positions. In other words, the elastic claws 62 enter the cavities 42 through the communication holes 43*a* of the wire housing block 40 (see FIG. 6). Subsequently, the wiring harness is preferably manufactured in the following method.

(1) With reference to FIG. 1, a plurality of wires are arranged on the wire arrangement board 10 as predesigned in the wire arranging process. This operation is performed by arranging the wires in accordance with the support members 20 standing upright on the board 10.

(2) Next, in the end retaining process, the ends of the branch wires W1 and the wires W2 to be connected with the branch wires W1, out of the arranged wires, are retained by the retainer A. This process can be advantageously performed during the wire arranging process. The retainer A is so disposed as to conform to the distance the wires W1 and W2 are pulled.

More specifically, the ends E of the wires W1 (W2) are inserted into the corresponding cavities 42 along the longitudinal direction of the wire housing block 40 through the openings 41*a*, as shown in FIG. 7, until the ends E of the wires W1 (W2) come into contact with bottom walls 42*a* of the cavities 42. On the other hand or tool, the elastic claws 62 in the cavities 42 are pressed by the wires W1 (W2) and undergo an elastic deformation. Thus, the wires W1 (W2) are held between the inner walls of the cavities 42 and the elastic claws 62, being prevented from moving in the direction opposite to the insertion direction. As a result, the ends of the wires W1 (W2) are retained by the wire retaining portion U. Since all the holes forming the cavities 42 have a specified depth, the ends E of the wires W1 (W2) can be retained while being aligned.

Particularly, in this embodiment, the elastic claws 62 formed by means of bending are disposed such that the leading portions thereof between the leading ends 62*b* and the peaks 62*a* are at an acute angle to the insertion direction of the wires W1 (W2). Accordingly, if the wires W1 (W2) try to come out of the cavities 42, the leading ends 62*b* of the elastic claws 62 are cut in the sheath of the wires W1 (W2), thereby securely preventing the wires W1 (W2) from coming out of the cavities 42. Therefore, the ends E of the wires W1 (W2) can be retained at one time while being aligned only by inserting the wires W1 (W2) to the bottom of the cavities 42.

(3) After the completion of the wire arranging operation, the thus formed bundle of wires are bound in specified positions by tapes T in the binding process. Taping may be suitably performed during the wire arranging operation.

(4) Next, in the releasing process, the wires W1 and W2 retained by the retainer A are released from the retainer A, and the taped bundle of wires are detached from the wire arrangement board 10. In this state, the ends E of the wires W1 and W2 remain aligned.

More specifically, if the wire housing block 40 remains accommodated in the casing 50, the elastic claws 62 deter the wires W1 and W2 from coming out of the wire housing block 40 and therefore the wires W1 and W2 cannot be released from the retainer A. Accordingly, in order to release the wires W1 and W2 from the retainer A, the wire housing block 40 is pulled in the direction opposite to the insertion direction while being gripped with a hand or tool to be withdrawn from the casing 50.

With reference to FIG. 8, while the wire housing block 40 is withdrawn from the casing 50, the peaks 62*a* of the elastic claws 62 reach the notches 54 of the casing 50. Thereby, the elastic claws 62 having been pressed by the side walls 53 of the casing 50 undergo an elastic deformation and is brought into their second positions. As a result, the elastic claws 62 move away from the wires W1 (W2). Since the elastic claws 62 do not stand to block the movement of the wires W1 and W2 in the direction opposite to the insertion direction, the wires W1 and W2 are allowed to come out of the cavities 42. In this state, the retained wires W1 and W2 are withdrawn at one time with their ends E aligned. The end portions of the wires W1 and W2 are preferably taped or bound before withdrawal of the wires W1 and W2 because it securely prevents the ends E from getting out of positions while the wires W1 and W2 are withdrawn.

(5) Then, in the end-processing process, the ends E of the wires W1 and W2 are processed at one time. More specifically, processing such as resistance welding, ultrasonic welding, soldering or mounting of terminals can be applied to all the wires W1 and W2 at one time.

As described above, according to this embodiment, the ends of the specified wires W1 and W2 are aligned and retained while the wires are arranged on the assembly line. Further, the wires W1 and W2 can be released together from the retainer A with their ends E aligned. Accordingly, after the wire arranging operation, the ends of the wires W1 and W2 can be easily processed at one time, with the result that the wiring harness can be more efficiently manufactured. In addition, according to this embodiment, even in the case of manufacturing a wiring harness including many branch wires, it is not necessary to use spliced wires and, therefore, the wire arranging operation can be smoothly performed.

Particularly, this embodiment has the following actions and effects.

First, since the wires W1 (W2) are individually inserted into the respective cavities 42, the number of the retained wires W1 and W2 can be easily counted. In other words, the operation can be performed while confirming the number of the retained wires W1 (W2). In this embodiment, the wire housing block 40 has six cavities 42. If the number of the wires W1 and W2 to be retained is less than the predetermined number of cavities, for example, five, a plug 46 is pressed into the opening 41*a* of any desired cavity 42. With such a precaution, if the wires W1 (W2) are inserted into all five cavities 42 as the wire arranging operation continues, an operator can easily and clearly see that all the wires W1 and W2 to be processed at one time have been retained. Particularly, if the plug(s) 46 is/are pressed into the cavity or cavities 42 from those at the upper stage(s) and the wires W1 and W2 are inserted into the cavities 42 from those at the lower stage(s), the remaining number of the wires W1 and W2 to be retained can be easily grasped.

The wire retaining portion U can be detached from the base 30. In other words, the wires W1 and W2 can be advantageously transferred while being retained. Specifically, the casing 50 is detached from the securing portion 32 of the base 30. The casing 50 is detached by gripping the casing 50 with a hand or tool and pulling it against the attraction of the magnet M. In the case where an apparatus for processing the ends of the retained wires at one time (e.g. an ultrasonic welder) is installed in a place of a separate process of manufacturing, the wire retaining portion U is transferred there. Upon arrival, the wire housing block 40 is withdrawn from the casing 50 and the ends of the wires are processed. If the end portions of the wires W1 and W2 are taped or bound before withdrawal of the wires W1 and W2, processing can be applied while the ends E of the wires W1 and W2 are securely aligned.

Further, the contact members 60 are made by bending thin plates and the inserted wires W1 and W2 are securely retained in the retainer A or allowed to come out depending upon the deformed state of contact members 60. With the contact members 60 of a simple structure, the retainer A can be manufactured at a reduced cost.

The invention is not limited to the foregoing embodiment. The number of the cavities 42 formed in the wire housing block 40 can be changed at will. Further, cam members which enter the cavities 42 upon being pressed by the side walls 53 of the casing 50 may be used as contact members 60. A variety of other design changes can be made.

Figure 9:
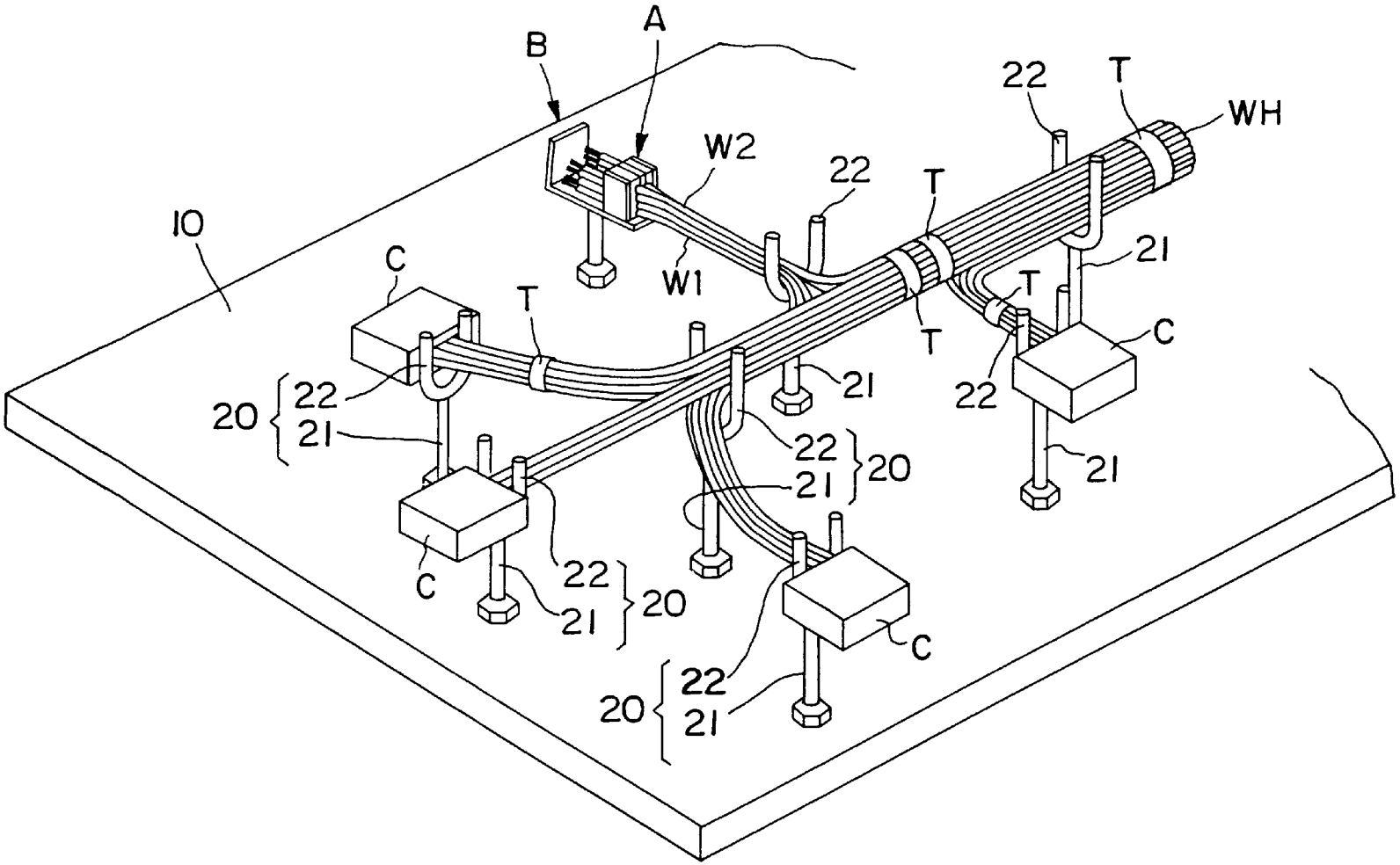
FIG. 9 is a perspective view showing an essential wiring harness manufacturing process using an assembling board equipped with a further retainer or retaining means according to a further embodiment of the invention.

FIG. 9 is a perspective view of a wiring harness WH being manufactured using an assembling board B equipped with a further wire end retainer (hereinafter, "retainer") A according to a further embodiment of the invention.

With reference to FIG. 9, the assembling board B is conveyed along a wiring harness assembly line by a specified conveying apparatus (not shown). Along this assembly line, there are performed a wire arranging process of arranging a plurality of wires, an end retaining process of retaining ends of wires W1 as branch wires and wires W2 to be connected with the branch wires W1, a binding process of binding the arranged wires, and a releasing process of releasing a bundle of wires from the assembling board B. By subsequently performing an end-processing process of simultaneously processing the ends of the wires W1 and W2, the assembling of the wiring harness WH is completed. Identified by C are connectors mounted at the ends of the wires, and identified by T are binding tapes for suitably binding the wires during the wire arranging process and the binding process.

The assembling board B includes a wire arrangement board 10, a plurality of support members 20, and a retainer A. The board 10 is made of, for example, a veneer. The board 10 is a base plate for arranging a plurality of wires forming the wiring harness. A predesigned shape of the wiring harness can be drawn on the upper surface of the board 10.

The support members 20 stand upright on the board 10. Each support member 20 includes a support 21 secured on the board 10 and a wire receptacle 22 provided at the upper end of the support 21. The wire receptacle 22 is substantially U-shaped. The respective wires are arranged as predesigned while being held by the wire receptacles 22.

The retainer A is adapted to retain the ends of all branch wires W1 and the ends of the wires W2 to be connected with the branch wires W1. The feature of this embodiment is that the ends of the wires W1 and W2 can be easily processed at one time by retaining the wires W1 and W2 by means of the retainer A with their ends aligned on the assembly line and by releasing the held wires W1 and W2 at one time.

Figure 10:
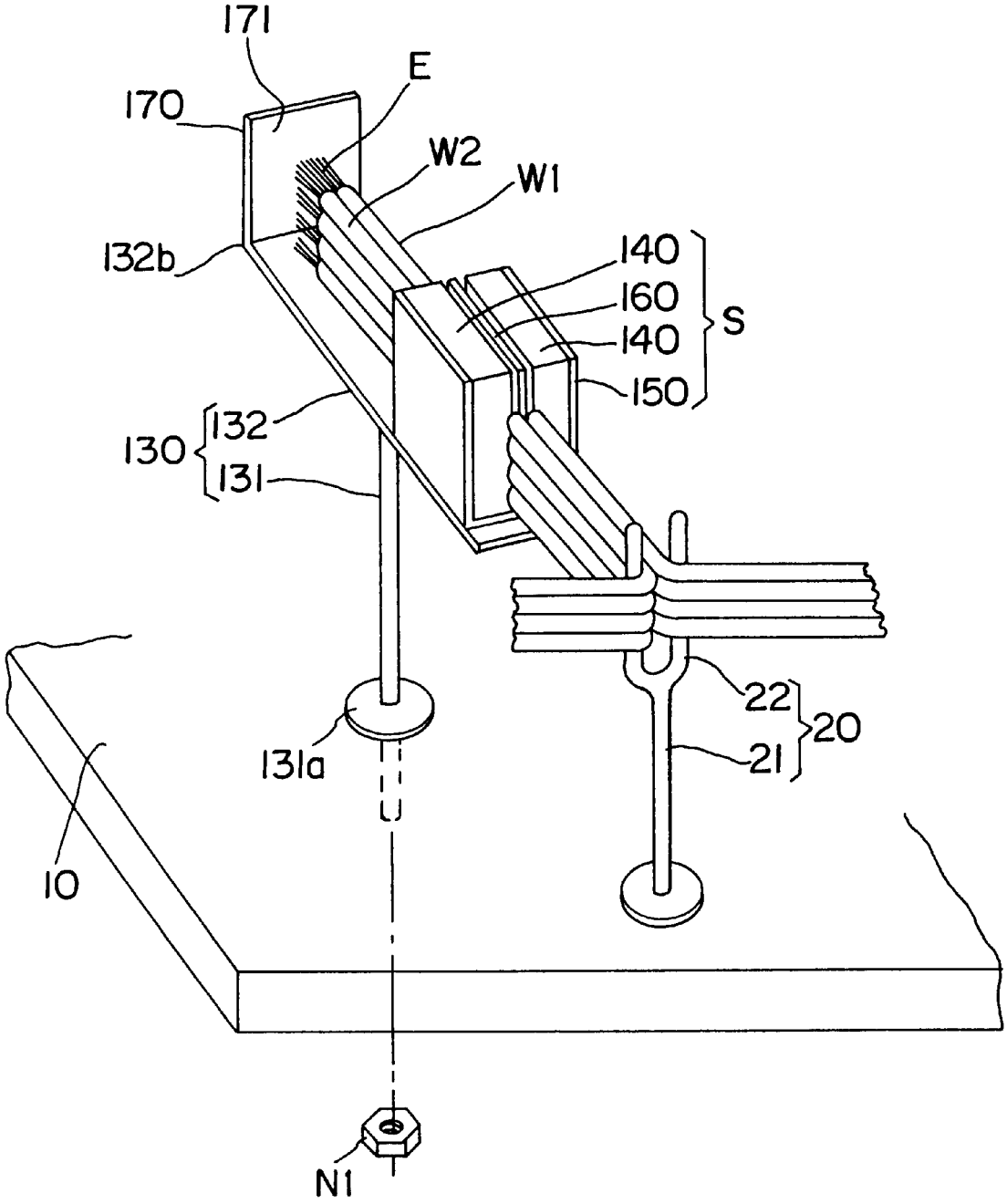
FIG. 10 is a perspective view showing a state where ends of specified wires are retained by the further retainer.
Figure 11:
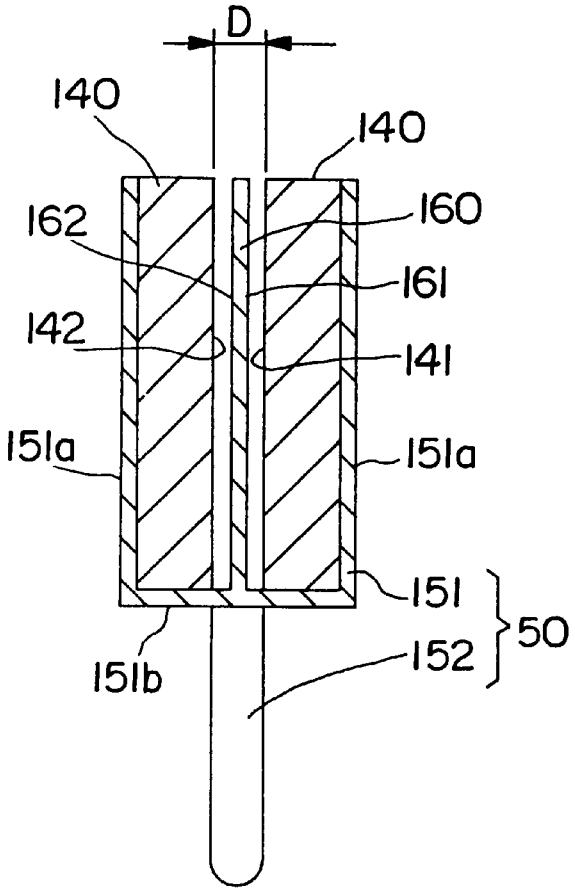
FIG. 11 is a section of an essential portion of the further retainer.
Figure 12:
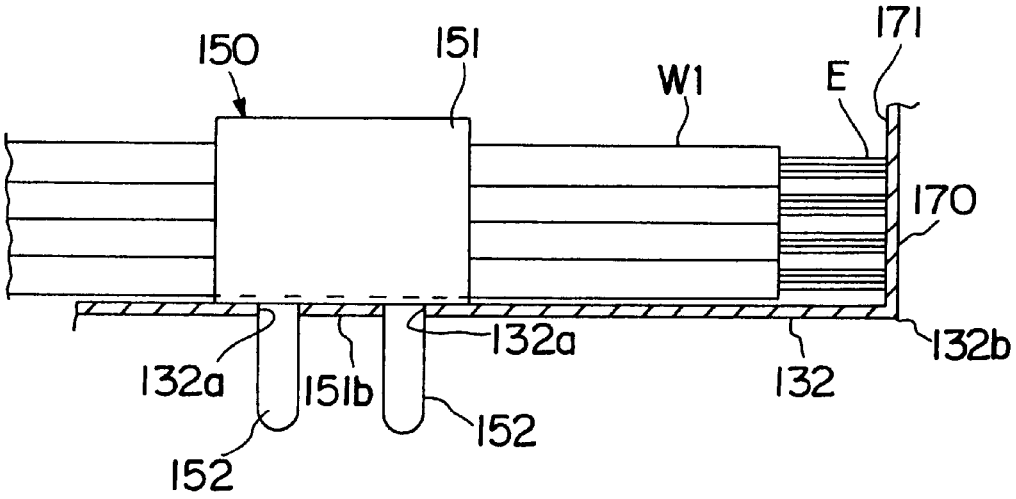
FIG. 12 is a side view partially in section of an essential portion of the further retainer retaining the wires.

With reference to FIGS. 10 to 12, the retainer A is described in detail.

The retainer A includes a base 130, a wire retaining portion S provided at the upper end of the base 130, and a contact plate 170 with which ends E of the wires W1 and W2 to be retained come into contact.

The base 130 includes a support 131 and a securing plate 132 for securing the wire retaining portion S. The support 131 is bar-shaped and secured on the wire arrangement board 10. Specifically, a fixing flange 131*a* is formed at a lower portion of the support 131, and an external thread is formed on the support 131 below the flange 131*a*. The lower portion of the support 131 is inserted through a mount hole formed in the board 10, and a nut N1 is screwed on the external thread 131*b* from the lower side of the board 10. In this way, the support 131 is secured on the board 10. On the other hand, the securing plate 132 is made of a flat rectangular plate and is formed with securing holes 132*a* used to secure the wire retaining portion S (see FIG. 12). The lower surface of the securing plate 132 is coupled with the upper end of the support 131. The securing plate 132 and the support 131 may be integrally formed, or may be separately formed and securely coupled.

The wire retaining portion S includes a pair of elastic blocks (hereinafter, merely "blocks") 140, a casing 150 for positioning and supporting the blocks 140, and a partition plate 160 provided between the blocks 140.

The blocks 140 are made of, e.g. rubber, resin, or like material and have a shape of a rectangular parallelepiped.

The casing 150 includes a frame 151 and preferably two legs 152 (see FIG. 12). The frame 151 is formed by bending a flat plate so as to have a substantially U-shaped cross section, and includes a pair of opposite side plates 151*a* and a bottom plate 151*b* connecting the side plates 151*a*. One block 140 is mounted in contact with one side plate 151*a* and the bottom plate 151*b*, whereas the other block 140 is mounted in contact with the other side plate 151*a* and the bottom plate 151*b*. Accordingly, opposite inner end surfaces 141 and 142 of the blocks 140 are spaced apart by a specified distance D. The inner end surfaces 141 and 142 form a retaining portion for retaining the ends of the wires W1 and W2.

The two legs 152 are round bars projecting downward from the bottom plate 151*b* of the frame 151, and are inserted through the securing holes 132*a* formed in the securing plate 132. In this way, the casing 150 is securely mounted such that it is permitted to make only an upward movement with respect to the securing plate 132. The legs 152 may not be round bars, but may be bars having a polygonal cross section. The number of the legs 152 does not have to be two. There may be three or more legs 152. In other words, it is sufficient to secure the casing 150 such that the casing 150 is permitted to make only an upward movement with respect to the securing plate 132.

The partition plate 160 is made of a flat plate and provided in the middle of the clearance D. The partition plate 160 extends along the inner end surfaces 141 and 142 of the blocks 140. Accordingly, end surfaces 161 and 162 of the partition plate 160 are opposed to the inner end surfaces 141 and 142 of the blocks 140, respectively. The partition plate 160 may be integrally formed with the bottom plate 151*b* of the casing 150, or may be separately formed and secured on the bottom plate 151*b* by means of welding or the like.

The contact plate 170 is made of a flat rectangular plate and provided at an end 132*b* of the securing plate 132. The front surface of the contact plate 170 acts as a contact surface 171 with which the ends E of the wires W1 and W2 to be retained come into contact. The contact surface 171 extends in a direction normal to the extending direction of the inner end surfaces 141 and 142 of the blocks 140. The contact plate 170 may be integrally formed with the casing 150 so as to extend therefrom.

Next, a preferred embodiment of a manufacturing method of the wiring harness with the use of the assembling board B and an operation of retaining the wires W1 and W2 using the retainer A are described.

At the beginning of manufacturing of the wiring harness, wires used to form the wiring harness are cut in desired lengths and terminals are mounted at ends of the desired wires by specified apparatuses. Further, the legs 152 of the casing 150 are inserted through the securing holes 132*a* of the securing plate 132, thereby mounting the wire retaining portion S on the base 130. Subsequently, the wiring harness is preferably manufactured in the following method.

(1) With reference to FIG. 9, a plurality of wires are arranged on the wire arrangement board 10 as predesigned in the wire arranging process. This operation is performed by arranging the wires in accordance with the support members 20 standing upright on the board 10.

(2) Next, in the end retaining process, the ends of the branch wires W1 and the wires W2 to be connected with the branch wires W1, out of the arranged wires, are retained by the retainer A. This process is performed during the wire arranging process.

The end retaining process is described in more detail with reference to FIG. 10. The end of the wire W1 (W2) out of the wires to be arranged during the wire arranging process are inserted into the clearance between the blocks 140 from above the wire retaining portion S. The inserted wire W1 (W2) causes the inner end surface 141 (142) of the block 140 to undergo an elastic deformation. Accordingly, a pressing force resulting from the elastic deformation is applied to the inserted wire W1 (W2), with the result that the end E of the wire W1 (W2) are pressingly held by the inner end surface 141 (142).

During the insertion of the wire W1 (W2), the end E thereof is brought into contact with the contact surface 171. Since the contact surface 171 extends in the direction substantially normal to the extending direction of the inner end surface 141 (142), the end E of the wire W1 (W2) is in contact with the contact surface 171, substantially normal thereto (see FIG. 12).

By repeating the above operation for all the wires W1 and W2, the ends E of the respective wires W1 and W2 can be aligned and retained. Further, since the inner end surfaces 141 and 142 extend in the longitudinal direction of the retained wires W1 and W2, the ends E of the wires W1 and W2 can be retained over a specified length. As a result, the wires W1 and W2 can be securely retained, thereby preventing the retained wires W1 and W2 from inadvertently coming out of the wire retaining portion S during the wire arranging operation.

(3) Again with reference to FIG. 9, after the completion of the wire arranging operation, the thus formed bundle of wires are bound in specified positions by tapes T in the binding process. Taping may be suitably performed during the wire arranging operation.

(4) Next, in the releasing process, the wires W1 and W2 retained by the retainer A are released from the retainer A. Specifically, the retained wires W1 and W2 are gripped with a hand or a tool and are pulled upward from the wire retaining portion S. Thereby, the wires W1 and W2 can be released at one time with their ends aligned. The wires W1 and W2 may be taped to be bundled before being pulled out. This advantageously prevents the aligned ends E from being displaced from one another while the wires W1 and W2 are pulled out.

(5) Then, in the end-processing process, the ends E of the wires W1 and W2 are processed at one time. For example, resistance welding, ultrasonic welding, soldering, mounting of terminals or like processing is applied to all the wires W1 and W2 at one time.

As described above, according to this embodiment, the ends of the specified wires W1 and W2 are aligned and retained while the wires are arranged on the assembly line. Further, the wires W1 and W2 can be released together from the retainer A with their ends E aligned. In addition, according to this embodiment, even in the case of manufacturing a wiring harness including many branch wires, it is not necessary to use spliced wires and, therefore, the wire arranging operation can be smoothly performed.

Particularly, this embodiment has the following actions and effects.

First, since the surfaces for pressing and retaining the wires W1 and W2 are formed by the inner end surfaces 141 and 142 of the blocks 140 of rubber, a special processing for forming these surfaces is not necessary, thereby suppressing a processing cost. Accordingly, by suppressing a cost for parts, the retainer A can be manufactured at a reduced cost. Further, the ends E of the wires W1 and W2 can be easily retained only by pressing them into the clearance between the pair of blocks 140 from above. This leads to a smooth wire arranging operation including alignment of the ends of the respective wires.

Further, the partition plate 160 is provided between the inner end surfaces 141 and 142. Accordingly, the wires W1 and W2 to be retained can be inserted between one inner end surface 141 and one end surface 161 of the partition plate 160 and between the other inner end surface 142 and the other end surface 162 of the partition plate 160. Therefore, using the partition plate 160, the wires W1 and W2 can be aligned in two rows. This is convenient when the ends E of the wires W1 and W2 are processed at one time after the wire arranging operation.

Further, since the wire retaining portion S can be detached from the base 130, the wires W1 and W2 can be advantageously transferred while being retained with their ends E aligned. As a result, the ends E of the wires W1 and W2 can be processed at one time without checking the state of the end portions and realigning the ends E. Thus, the processing can be smoothly performed. Specifically, the processing can be performed as shown in FIG. 13.

Figure 13:
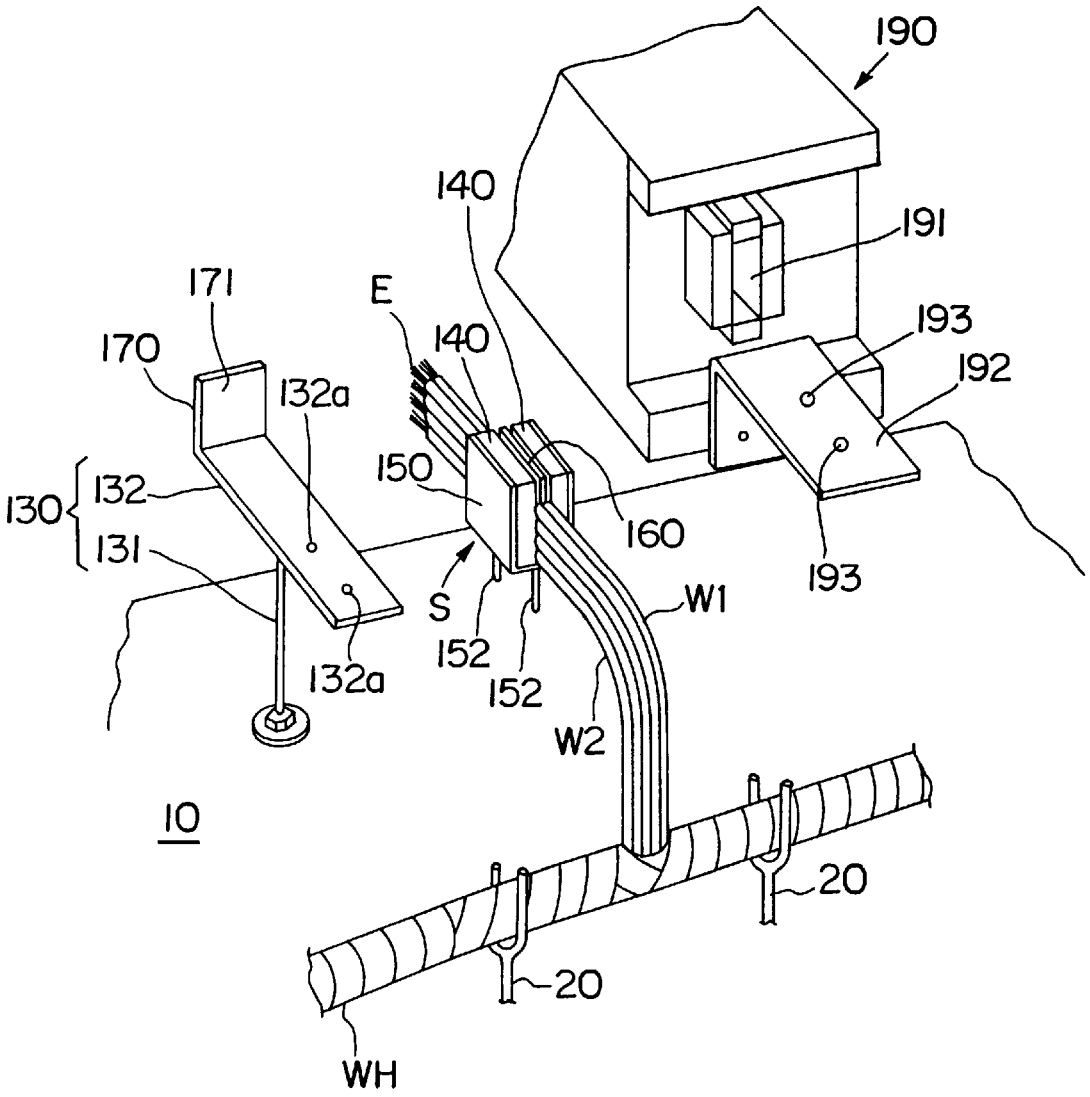
FIG. 13 is a perspective view showing an ultrasonic welding operation during an end-processing process.

With reference to FIG. 13, identified by 190 is an ultrasonic welder installed near the assembly line for the wiring harnesses. The wire retaining portion S retaining the wires W1 and W2 can be easily detached by pulling the legs 152 of the casing 150 upward from the securing plate 132 of the base 130. In this state, the ends E of the wires W1 and W2 are retained and aligned. Subsequently, the wire retaining portion S is transferred to a welding portion 191 of the ultrasonic welder 190 while being gripped with a hand or tool. Identified by 192 is a bracket mounted on the ultrasonic welder 190. The wire retaining portion S detached from the base 130 is mounted on the bracket 192. The bracket 192 is formed with holes 193 similar to the securing holes 132*a* formed in the securing plate 132 of the base 130. By inserting the legs 152 of the casing 150 of the wire retaining portion S through the holes 193, the wire retaining portion S is secured on the bracket 192. At this stage, the ends E of the wires W1 and W2 are properly positioned with respect to the welding portion 191. In addition, since the ends of the wires W1 and W2 aligned in two rows conform to the shape of the welding portion 191, a satisfactory welding can be performed.

The invention is not limited to the foregoing embodiment, and the following modifications can be considered.

Figure 14:
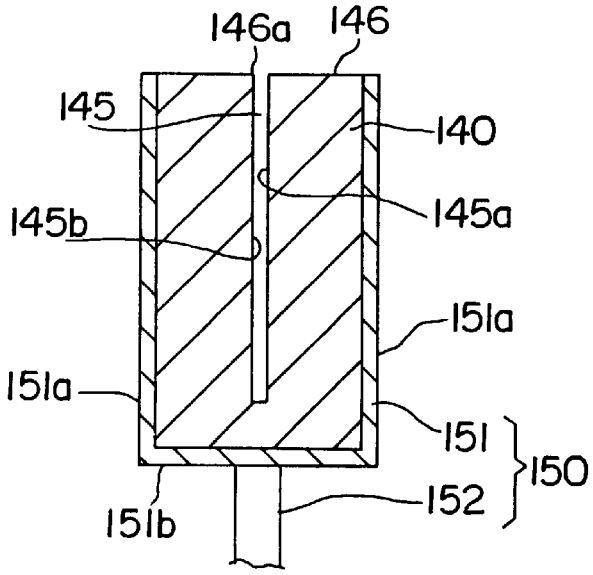
FIG. 14 is a section of an essential portion of a wire retaining portion according to one modification.
Figure 15:
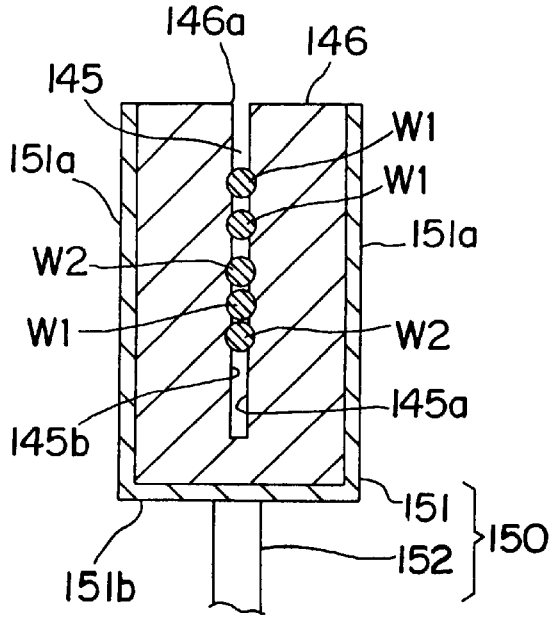
FIG. 15 is a section showing a state where wires are retained by the wire retaining portion according to the modification.

FIG. 14 is a section of a wire retaining portion S according to one modification. As opposed to the foregoing embodiment in which a pair of blocks 140 are opposed to each other and retaining surfaces are formed by the opposite end surfaces 141 and 142, the feature of this modification is that a groove 145 is formed in a single block 140 and retaining surfaces are formed by opposite inner wall surfaces 145*a* and 145*b* of the groove 145. The groove 145 has an opening

146*a* in an upper surface 146 of the block 140 and extends over an entire dimension of the block 140 along the longitudinal direction of the wires W1 (W2) to be retained. Further, a partition plate 160 shown in the foregoing embodiment is not provided in this modification. Since the other construction is similar to that of the foregoing embodiment, no description is given thereto.

This modification has the same action as the foregoing embodiment. Particularly, in this modification, when the ends of the wires W1 and W2 to be retained are pressed into the groove 145 from above through the opening 146*a* along the radial direction thereof, they are retained between the inner wall surfaces 145*a* and 145*b* of the groove 145. Thus, this embodiment has the same effects as the foregoing embodiment.

Figure 16:
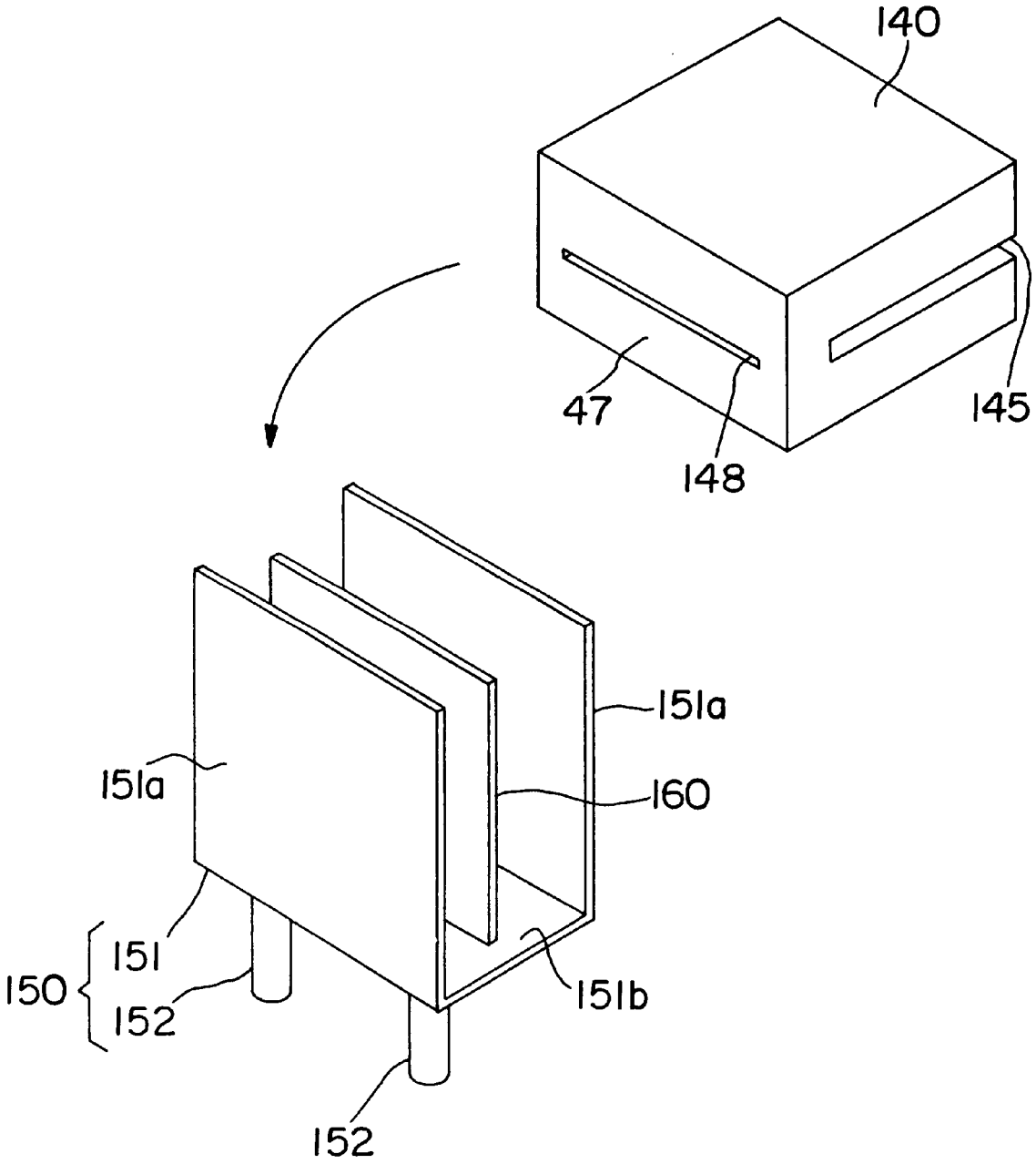
FIG. 16 is an exploded perspective view of a wire retaining portion according another modification.
Figure 17:
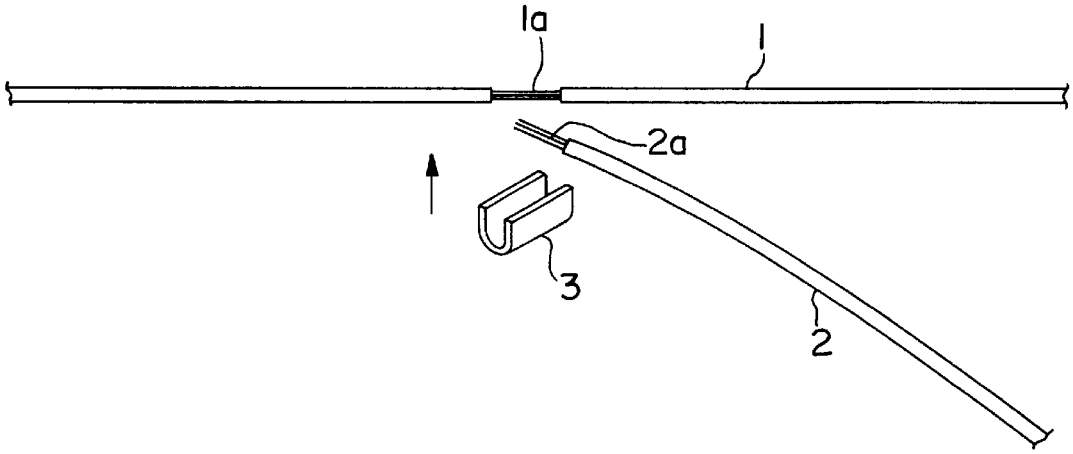
FIG. 17 PRIOR ART
FIG. 17 is a perspective view showing how a prior art branch wire is formed.

Further, as shown in FIG. 16, a partition plate 160 may be provided. In this case, a hole 148 in communication with the interior of the groove 145 is formed in a bottom portion 147 of the block 140. The block 140 can be mounted in the casing 150 by inserting the partition plate 160 through the hole 148. The action and effects similar to the foregoing embodiment can be obtained in this case as well.

Furthermore, a variety of design changes can be made without departing from the spirit and scope of the invention as defined in the claims.

LIST OF REFERENCE NUMERALS

| | |
|---|---|
| A | Retainer |
| B | Assembling Board |
| U | Wire Retaining Portion |
| E | Wire End |
| W1 | Wire |
| W2 | Wire |
| 10 | Wire Arrangement Board |
| 30 | Base |
| 40 | Wire Housing Block |
| 41 | End Surface |
| 41a | Opening |
| 42 | Cavity |
| 42a | Bottom Wall |
| 50 | Casing |
| 51a | Opening |
| 60 | Contact Member |
| 62 | Elastic Claw |
| 130 | Base |
| 140 | Block |
| 141 | Inner End Surface |
| 142 | Inner End Surface |
| 150 | Casing |
| 160 | Partition Plate |
| 170 | Contact Plate |
| 171 | Contact Surface |

What is claimed is:

1. A wire harness assembly apparatus comprising:

a plurality of separate wires, each said wire having at least one end, a conductive core extending continuously along each said wire from said end, a sheath surrounding the conductive core of each said wire, the sheath defining an outside diameter, a portion of each said sheath along a selected length from said end being removed for exposing said conductive core;

at least one wire retaining portion having opposed parallel front and rear walls, a plurality of cavities having entrances in said front wall and extending to said rear wall, each said cavity being cross-sectionally dimensioned for receiving a section of one said wire with the sheath thereon, a sheath contact member mounted in each said cavity of said wire retaining portion and being spaced from said rear wall a distance greater than the length of the exposed conductive core at the end of the respective wires, said sheath contact members being configured for releasably engaging said sheaths and for releasably retaining said wires in the respective cavities, whereby the wires can be bound in proximity to said wire retaining portion and subsequently released from the wire retaining portion with the respective ends substantially aligned.

2. The wire harness assembly apparatus of claim 1, wherein each said contact member is movable between a first position where said contact member is in contact with the sheath of a respective one of the wires accommodated in a corresponding one of the cavities and a second position where the contact member is spaced away from the wires.

3. The wire harness assembly apparatus of claim 2, wherein the contact member restricts movement of the wires in a direction opposite to an insertion direction in the first position of the contact member by cutting into the sheath.

4. The wire harness assembly apparatus of claim 1, wherein said at least one wire retaining portion comprises a plurality of wire retaining portions, said apparatus further comprising a board, said wiring retaining portions being removably mounted to said board at a plurality of spaced apart locations thereon.

5. The wire harness assembly apparatus of claim 4, wherein the plurality of wires are arranged into a plurality of branches, said plurality of branches corresponding in number to said plurality of wire retaining portions, such that the wires of each said branch are releasably engaged in a selected one of said wire retaining portions.

6. The wire harness assembly apparatus of claim 5, wherein said board is substantially planar, said wire retaining portions being mounted such that the cavities are aligned substantially parallel to the board.

7. The wire harness assembly apparatus of claim 6, further comprising a plurality of wire supports for supporting said wires at locations spaced from said wire retaining portions.

8. The wire harness assembly apparatus of claim 6, further comprising a plurality of supports removably mounted to said board, each said support having an end remote from said board, said wire retaining portions being mounted to said ends of said support for supporting said wires in spaced relationship to said board.

9. The wire harness assembly apparatus of claim 8, wherein each said wire retaining portion is removably connected to the end of the respective support.

10. The wire harness assembly apparatus of claim 1, wherein said wire retaining portion comprises means for selectively moving each said contact member into and out of engagement with the sheath of the wire mounted in the respective cavity.

* * * * *